US010655832B2

(12) United States Patent
Buhl

(10) Patent No.: US 10,655,832 B2
(45) Date of Patent: May 19, 2020

(54) HEAD LAMP OR FLASHLIGHT

(71) Applicant: LEDLENSER GMBH & CO. KG, Solingen (DE)

(72) Inventor: Erich Buhl, Solingen (DE)

(73) Assignee: LEDLENSER GmbH & CO. KG, Solingen (DE)

( * ) Notice: Subject to any disclaimer, the term of this patent is extended or adjusted under 35 U.S.C. 154(b) by 0 days.

(21) Appl. No.: 16/065,183

(22) PCT Filed: Dec. 20, 2016

(86) PCT No.: PCT/DE2016/100605
§ 371 (c)(1),
(2) Date: Jun. 22, 2018

(87) PCT Pub. No.: WO2017/108031
PCT Pub. Date: Jun. 29, 2017

(65) Prior Publication Data

US 2019/0017691 A1 Jan. 17, 2019

(30) Foreign Application Priority Data

Dec. 22, 2015 (DE) ..... 20 2015 106 996 U

(51) Int. Cl.
*F21V 23/04* (2006.01)
*F21V 5/08* (2006.01)
(Continued)

(52) U.S. Cl.
CPC ..... *F21V 23/0492* (2013.01); *F21L 4/00* (2013.01); *F21L 4/027* (2013.01); *F21V 5/006* (2013.01);
(Continued)

(58) Field of Classification Search
None
See application file for complete search history.

(56) References Cited

U.S. PATENT DOCUMENTS 5,562,336 A * 10/1996 Gotou ..... B60Q 1/085 362/276
5,787,370 A * 7/1998 Kutscher ..... B60G 17/0195 701/49
(Continued)

FOREIGN PATENT DOCUMENTS

| | | |
|---|---|---|
| EP | 1106432 | 6/2001 |
| EP | 2615016 | 7/2013 |
| EP | 2947371 | 11/2015 |

OTHER PUBLICATIONS

International Search Report and Written Opinion for Application No. PCT/DE2016/100605 dated Mar. 4, 2017.

*Primary Examiner* — Ashok Patel
(74) *Attorney, Agent, or Firm* — Alston & Bird LLP

(57) ABSTRACT

The present invention relates to a head lamp or flashlight (1) comprising a light source (2) and an auxiliary optical unit (3). In order to propose a head lamp or flashlight (1), the emitted light cone (10, 10') of which generates a stable light cone (10, 10') even in the case of movements and/or vibrations and which allows a uniform and flicker-free illumination of the path (9, 9') ahead, it is proposed that the light source consists of a matrix (2) having a plurality of light emitting diodes (LEDs) or having a plurality of groups of LEDs which are positioned differently relative to the auxiliary lens (3), such that the different LEDs or the different groups of LEDs generate light cones (10, 10') with different emission angles with respect to the optical axis (7) of the lamp, wherein the matrix (2) is connected to a microprocessor (4) which, depending on input data, regulates which LED or which group of LEDs of the matrix (2) is luminous, as a result of which a stable light cone (10, 10') is emitted independently of a movement of the lamp (1).

18 Claims, 3 Drawing Sheets

(51) Int. Cl.

| | |
|---|---|
| ***F21V 21/084*** | (2006.01) |
| ***F21Y 105/10*** | (2016.01) |
| ***F21Y 115/10*** | (2016.01) |
| ***F21V 5/00*** | (2018.01) |
| ***F21L 4/02*** | (2006.01) |
| ***F21L 4/00*** | (2006.01) |

(52) U.S. Cl.
CPC ..... *F21V 5/08* (2013.01); *F21V 21/084* (2013.01); *F21Y 2105/10* (2016.08); *F21Y 2115/10* (2016.08)

(56) References Cited

U.S. PATENT DOCUMENTS

| | | | | |
|---|---|---|---|---|
| 6,367,949 | B1 * | 4/2002 | Pederson | B60Q 1/2611 362/240 |
| 2004/0263346 | A1 | 12/2004 | Neal | |
| 2012/0236537 | A1 * | 9/2012 | Pickard | F21K 9/00 362/84 |
| 2013/0329439 | A1 | 12/2013 | Hellkamp | |
| 2014/0268837 | A1 * | 9/2014 | Simchak | B60Q 1/12 362/465 |
| 2017/0327030 | A1 * | 11/2017 | Kim | B60Q 1/115 |

* cited by examiner

HEAD LAMP OR FLASHLIGHT

FIELD OF THE DISCLOSURE

The present invention relates to a headlamp or flashlight with a light source and an auxiliary lens.

BACKGROUND

These types of lamps have been known for decades, and have been employed as mobile lamps in flashlight form, or as headlamps. In the preceding years, such lamps—and in particular headlamps—have largely replaced the conventional lighting of bicycles, because a significantly better and more targeted illumination of the path lying ahead is possible with headlamps. However, headlamps react relatively sensitively in the event of possible shocks and slight head movements, which leads to an unsteady light cone, and thereby leads to a flickering illumination. Flashlights are also connected to the handlebar of a bicycle in a similar fashion with suitable connecting elements and consequently, are subjected to similar shocks, which likewise leads to an unsteady light cone and a flickering illumination, and comes with disadvantages for the cyclist.

SUMMARY OF SOME EXAMPLE EMBODIMENTS OF THE INVENTION

It is therefore the object of the present invention to propose a headlamp or flashlight, the emitted light cone of which generates a stable light cone even in the case of movements and/or shocks, and which permits a uniform and flicker-free illumination of the path lying ahead.

This object is achieved by the lamp according to claim 1. According to the invention, it is provided that the light source consists of a matrix with multiple light-emitting diodes (LEDs), or with multiple groups of LEDs, which are positioned differently relative to the auxiliary lens, so that the different LEDs or the different groups of LEDs generate light cones with different emission angles with respect to the optical axis of the lamp, wherein the matrix is connected to a microprocessor which regulates, depending on input data, which LED or which group of LEDs of the matrix is luminous, wherewith a stable cone of light is emitted, independently of a movement of the lamp.

The lamp, according to this, has multiple light-emitting diodes or other suitable light sources, which are controllable by a microprocessor. Here, the LEDs are individually or in groups positioned relative to the same auxiliary lens in such a way that different light cones with a different angle to the optical axis of the lamp are generated. The decision of which LED must be luminous is here determined on the basis of suitable input data, which are processed by the microprocessor according to a predetermined logic.

Through the interaction between the matrix out of light-emitting diodes, the auxiliary lens, and the microprocessor, it is now possible to compensate for shocks or other movements of the lamp in that the microprocessor, depending on the possible movements of the lamp, controls different LEDs, and hereby compensates for a pivotal movement of the lamp. With respect to the stationary environment, the emitted light cone comprises, after all this, a constant orientation with respect to a horizontal and a stable position, whereas the optical axis of the lamp is positionally-unstable as a result of shocks and/or movements.

Preferred embodiments of the present invention are explained in the dependent claims, as well as in the following.

According to a first preferred configuration of the invention, a gyroscopic sensor is provided, which registers movements of the lamp, and generates a data set, which corresponds to the input data of the microprocessor. Such gyroscopic sensors are already known according to the prior art and generate suitable data sets, which can be processed by the preferably used microprocessor.

According to an advantageous configuration of the invention, the lamp further has an LED driver, which is electrically interconnected between the matrix and the microprocessor.

The number of LEDs, or of LED groups is in itself optional, wherein an as great as possible number of LEDs with different distances to the optical axis is advantageous. Claimed, however, is at least one matrix from three LEDs arranged one on top of the other, so that pitching movements or vertical shocks can be compensated for via the control of different LEDs. In the neutral setting, the middle LED is luminous, so that a downward pitching movement of the flashlight leads to the bottom LED to be controlled, which causes an "upward" positional correction of the emitted light cone. In a similar manner, an upward pitching movement of the lamp is compensated for by a controlling of the upper light-emitting diode, which generates a light cone which is inclined further "downward" than it corresponds to the middle and neutral LED position. Through the arrangement of the, for example, 11, 17 or more LEDs arranged one on top of the other, the variance of the possible emission angle is increased, and a nearly uniform illumination is possible with different angle settings and movements of the lamp.

According to a further, preferred configuration of the invention, it is moreover provided that the matrix of LEDs possesses at least three LEDs arranged next to one another, so that horizontal pivoting movements of the lamp can also be compensated for.

In particular in the use of headlamps and flashlights as bicycle lighting, the problem frequently occurs that the lamps are not always oriented at the same position and with the same angular position to the horizontal. For this reason, the lamp, according to a preferred configuration of the invention, has a calibration device, which allows for a calibration of the emitted light cone prior to use. Insofar, it can be excluded, that during the start-up of the lamp, the neutral position, in which the middle LED generates the desired neutral emission of the light cone, must first laboriously be set up.

Preferably, the calibration device is connected with the gyroscopic sensor, which, for the calibration of the lamp, determines the orientation thereof in relation to a horizontal, so that, independently of the initial position of the lamp, a horizontal light cone can be generated.

The position of the light sources and the geometry of the lens are to be adapted to one another in order to ensure that a substantially similar light cone with different angles of inclination to the optical axis is generated by each light source. According to a preferred configuration of the invention, it is additionally provided that the auxiliary lens is a lens with a cross-sectionally substantially circle-segment-shaped light exit surface and a rearward recess, which forms a light entrance surface. With respect to an optical axis, the rearward recess is preferably designed asymmetrical, and the asymmetrical rearward recess is preferably designed in such a manner that the lens thickness, seen parallel to the optical axis, constantly increases from a lower position up to an upper position. A varying lens thickness thereby results parallel to the optical axis, wherein the greatest lens thickness exists at the lowest light source, and the comparatively smallest lens thickness exists at the position of the uppermost light source. Through these positional and thickness relationships, it is ensured that the emitted light cone is constant, independently of the respectively controlled light source, and only comprises a variable emission angle relative to a horizontal optical axis.

Transversally to the optical axis, the lens has an elongated shape, so that a broad illumination of the path lying ahead is established. Advantageously, the light exit surface is designed as a cylinder surface, wherein the longitudinal axis of the cylinder extends vertically to the optical axis of the lamp, and parallel to the horizontal.

BRIEF DESCRIPTION OF THE FIGURES

A specific configuration of the present invention is subsequently explained with reference to the figures. The Figures show in.

DETAILED DESCRIPTION OF EXAMPLE EMBODIMENTS OF THE INVENTION

Figure 1:
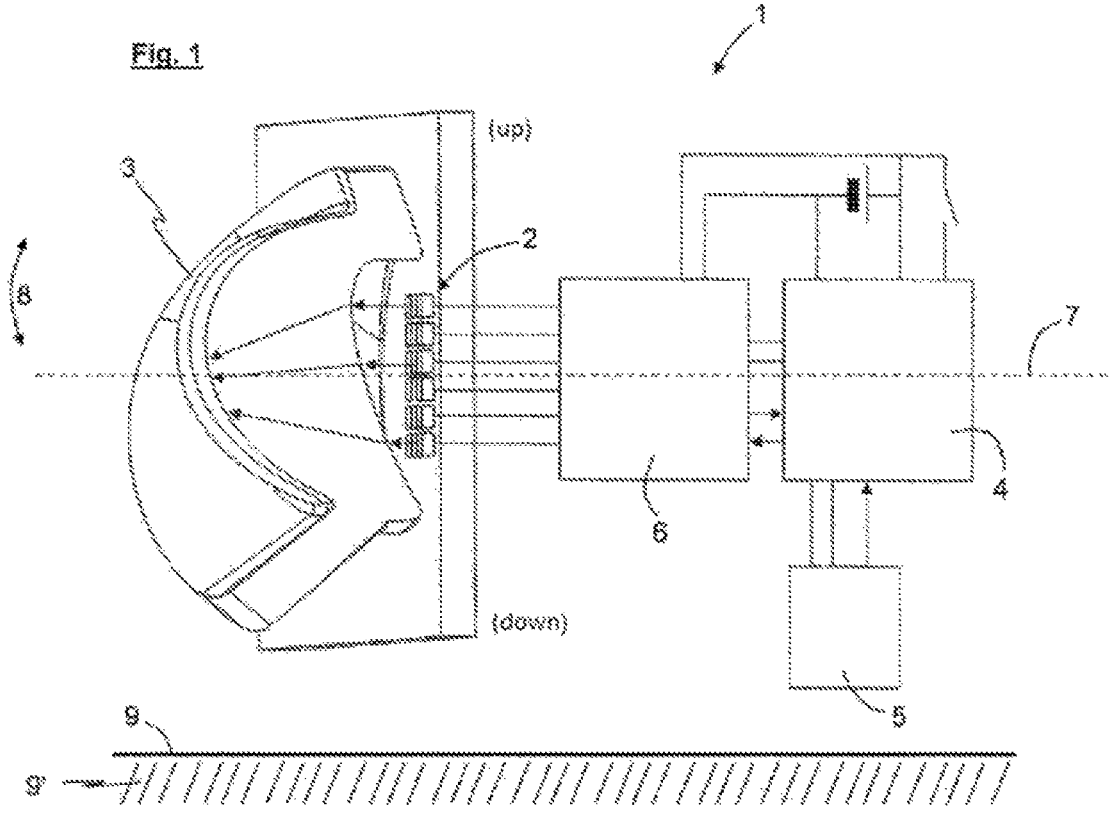
FIG. 1 a schematic representation of a specific embodiment of a lamp with the substantial components, FIG. 2*a, b* lamps with different angular positions relative to the optical axis, and FIG. 3 a cross-sectional representation of a specific embodiment of an auxiliary lens according to the invention.

FIG. 1 shows the substantial components of a lamp 1 with the matrix 2 with six LEDs arranged one on top of the other, an auxiliary lens 3, a microprocessor 4, a gyroscopic sensor 5 and an LED driver 6. In the illustrated exemplary embodiment, the matrix 2 is limited to a row of five light-emitting diodes arranged one on top of the other. These are differently positioned relative to the auxiliary lens 3 arranged in front thereof, and generate different light cones with a different angle of inclination relative to the optical axis 7 of the lamp 1.

In case of use, the gyroscopic sensor 5 registers a possible movement of the lamp 1, in particular a pitching movement, in which the optical axis 7 of the lamp 1 is pivoted in the direction of the arrow, and sends the corresponding data to the microprocessor 4. Via the LED driver 6, the processed signals are forwarded to the matrix 2 out of LEDs, which illuminate according to the specifications of the microprocessor 4. If one uses the auxiliary lens 3 represented in FIG. 1, a pitching movement of the lamp 1 in the direction of the arrow 8 is thus compensated for, so that—when the movement occurs downwardly—one of the lower LEDs is controlled, the light cone of which (with respect to the optical axis 7) is emitted further upwardly. In the reverse case, in which an upward pitching movement occurs, an LED is controlled, which is arranged above the optical axis 7, and the light cone of which is emitted further upwardly. Through a quick calculation of the respective assignments, an immediate stabilization of the emitted light cone is possible despite shocks.

Figure 2A:
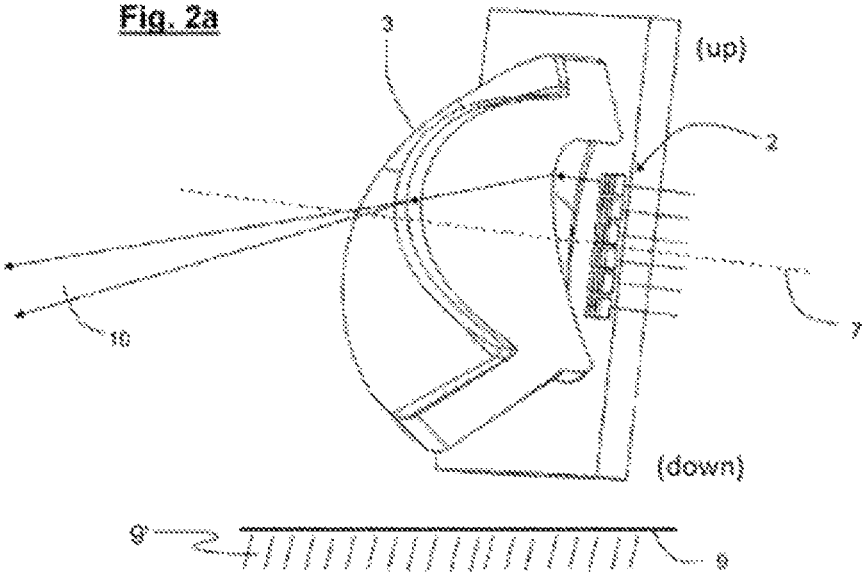
Figure 2B:
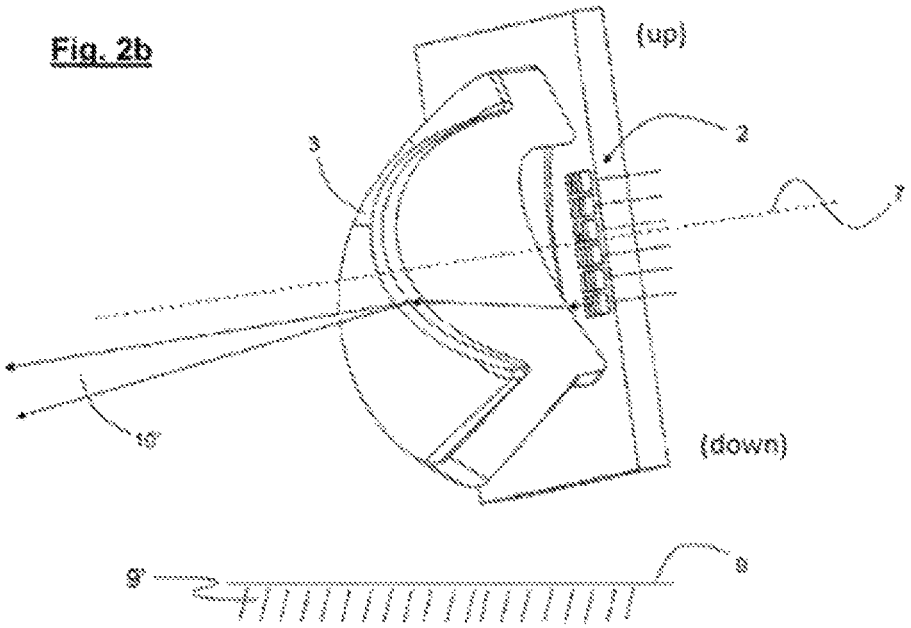

The FIGS. 2*a, b* show the lamp 1 with different angular positions of the optical axis 7 relative to a horizontal 9, or relative to the ground 9', and the different light cones 10, 10' which are generated by the LEDs respectively controlled to compensate for the movement.

Figure 3:
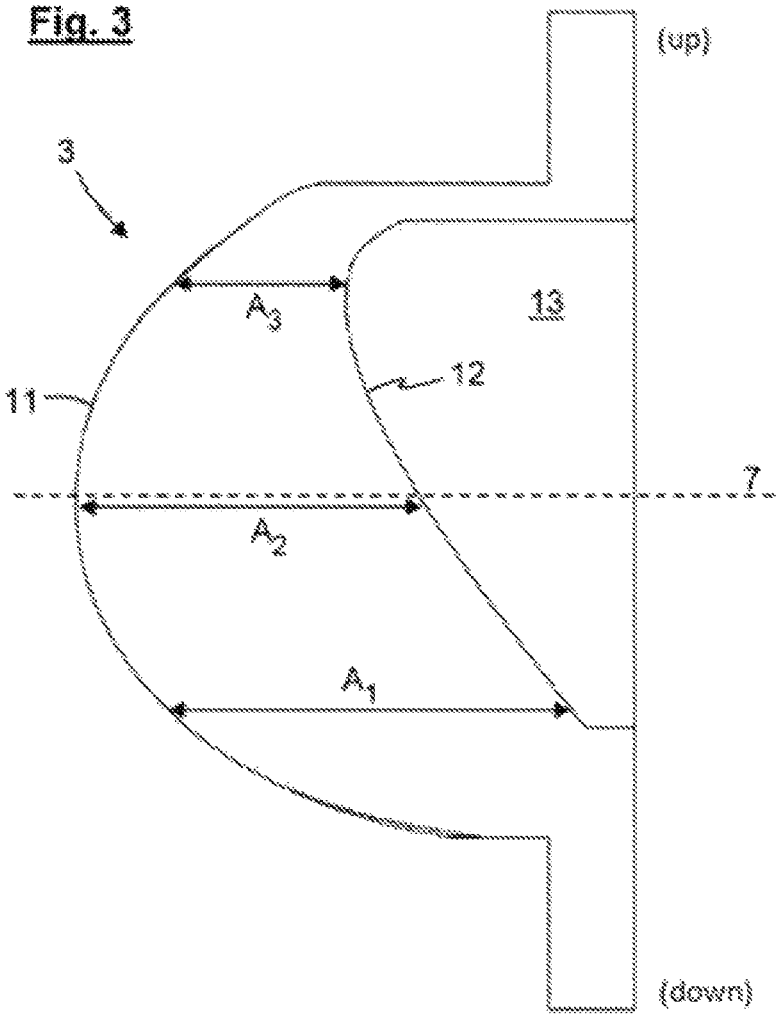

FIG. 3 illustrates a cross-sectional representation of a specific embodiment of an auxiliary lens 3. The auxiliary lens 3 has a light exit surface 11, which is configured substantially as a circle segment. The auxiliary lens 3 rearwardly comprises a recess, the front face 12 of which is formed as a light entrance surface and which, with respect to the optical axis 7, is asymmetrically designed. The asymmetrical design of the rear opening is characterized by the fact that the lens thickness in the lower region of the opening, that is the region, which is facing the ground 9' during intended use is substantially greater than the lens thickness in the upper region, which is facing away from the ground 9'. The lens thickness here refers to the distance between the light entrance surface and the light exit surface parallel to the optical axis 7. In FIG. 3, it is clearly discernible that the distance A1 at the bottom end of the rear opening is substantially larger than the distance A2, which is arranged in the vicinity of the optical axis 7, as well as the distance A3, which exists at the upper end of the rear opening, and parallel to the optical axis 7. The front face 12 of the rear opening can—as in the illustrated exemplary embodiment—be configured to be curved or flat.

The invention claimed is:

1. Lamp with a light source controlled by a microprocessor and having an auxiliary lens, characterized in that the light source comprises a matrix with multiple light-emitting diodes (LEDs), or with multiple groups of LEDs, which are differently positioned relative to the auxiliary lens, wherein the different LEDs or the different LED groups generate light cones with different emission angles with respect to an optical axis of the lamp, wherein the matrix is connected with the microprocessor of the lamp, which regulates, depending on input data, which LED or which group of LEDs of the matrix is luminous, whereby a stable light cone is emitted, independently of a movement of the lamp, wherein the LEDs, or groups of LEDs, of the matrix are arranged with at least one LED on top of another LED, and wherein, in an instance in which the input data indicates a pitching movement of the lamp in a vertical direction, the microprocessor is configured to cause an LED, or a group of LEDs, displaced in the same vertical direction with respect to the matrix of LEDs to luminate.

2. Lamp according to claim 1, further comprising a gyroscopic sensor, operably connected to the microprocessor, which registers the movements of the lamp and generates a data set, which corresponds to the input data of the microprocessor.

3. Lamp according to claim 1, further comprising an LED driver, which is electrically interconnected between the matrix and the microprocessor of the lamp.

4. Lamp according to claim 1, characterized in that the matrix consists of at least three LEDs arranged with at least one LED on top of another LED, so that pitching movements or vertical shocks can be compensated for via control of different LEDs.

5. Lamp according to claim 1, characterized in that the matrix has at least three LEDs arranged next to one another so that horizontal pivoting movements of the lamp can also be compensated for.

6. Lamp according to claim 1 further comprising a calibration device, operably connected to the microprocessor, which permits a calibration of the emitted light cone prior to the use of the lamp.

7. Lamp according to claim 6, further comprising a gyroscopic sensor connected to the calibration device, which determines the orientation of the lamp in relation to a horizontal, so that, independently of the initial position of the lamp, a horizontal light cone can be generated.

8. Lamp according to claim 1, characterized in that the auxiliary lens forms a lens with a cross-sectionally substantially circle-segment-shaped light exit surface and a rearward opening, which forms a light entrance surface.

9. Lamp according to claim 8, characterized in that the rearward opening is asymmetrical with respect to an optical axis.

10. Lamp according to claim 9, characterized in that the asymmetrical rearward opening of the auxiliary lens is configured in such a manner that a lens thickness, when seen parallel to the optical axis and from a lower position up to an upper position, constantly increases.

11. Lamp comprising a light source and an auxiliary lens, characterized in that, the light source consists of a matrix with multiple light-emitting diodes (LEDs), or with multiple groups of LEDs, which are differently positioned relative to the auxiliary lens, so that the different LEDs or the different LED groups generate light cones with different emission angles with respect to an optical axis of the lamp, wherein the matrix is connected with a microprocessor of the lamp, which regulates, depending on input data, which LED or which group of LEDs of the matrix is luminous, whereby a stable light cone is emitted, independently of a movement of the lamp, and wherein the auxiliary lens forms a lens with a cross-sectionally substantially circle-segment-shaped light exit surface and a rearward opening, which forms a light entrance surface and the rearward opening is asymmetrical with respect to an optical axis.

12. Lamp according to claim 11, further comprising a gyroscopic sensor, operably connected to the microprocessor of the lamp, which registers the movements of the lamp and generates a data set, which corresponds to the input data of the microprocessor.

13. Lamp according to claim 11, further comprising an LED driver, which is operably connected between the matrix and the microprocessor of the lamp.

14. Lamp according to claim 11, wherein the matrix consists of at least three LEDs arranged with at least one LED on top of another LED, so that pitching movements or vertical shocks can be compensated for via a control of different LEDs.

15. Lamp according to claim 11, wherein the matrix has at least three LEDs arranged next to one another so that horizontal pivoting movements of the lamp can also be compensated for.

16. Lamp according to claim 11, further comprising a calibration device, operably connected to the microprocessor, which permits a calibration of the emitted light cone of the lamp prior to the use of the lamp.

17. Lamp according to claim 16, further comprising a gyroscopic sensor operably connected to the calibration device, which, for the calibration of the lamp, determines the orientation thereof in relation to a horizontal, so that, independently of the initial position of the lamp, a horizontal light cone can be generated.

18. Lamp according to claim 11, wherein the asymmetrical rearward opening of the auxiliary lens is configured in such a manner that a lens thickness, when seen parallel to the optical axis and from a lower position up to an upper position, constantly increases.

* * * * *